US010358261B2

(12) United States Patent
Sugita

(10) Patent No.: US 10,358,261 B2
(45) Date of Patent: Jul. 23, 2019

(54) INNER PLUG STRUCTURE FOR FLEXIBLE CONTAINER AND FLEXIBLE CONTAINER

(71) Applicant: YOSHIDA INDUSTRIES CO., LTD., Tokyo (JP)

(72) Inventor: Tomofumi Sugita, Tokyo (JP)

(73) Assignee: YOSHIDA INDUSTRIES CO., LTD., Tokyo (JP)

( * ) Notice: Subject to any disclaimer, the term of this patent is extended or adjusted under 35 U.S.C. 154(b) by 0 days.

(21) Appl. No.: 15/987,899

(22) Filed: May 24, 2018

(65) Prior Publication Data

US 2018/0339806 A1 Nov. 29, 2018

(30) Foreign Application Priority Data

May 26, 2017 (JP) ..... 2017-104125

(51) Int. Cl.

| | |
|---|---|
| ***B65D 23/06*** | (2006.01) |
| ***B65D 35/10*** | (2006.01) |
| ***B65D 35/46*** | (2006.01) |
| ***B65D 39/00*** | (2006.01) |
| ***B65D 35/36*** | (2006.01) |
| ***B65D 47/20*** | (2006.01) |

(52) U.S. Cl.

CPC ..... *B65D 23/06* (2013.01); *B65D 35/10* (2013.01); *B65D 35/36* (2013.01); *B65D 35/46* (2013.01); *B65D 39/0052* (2013.01); *B65D 47/2018* (2013.01)

(58) Field of Classification Search

CPC ..... B65D 23/06; B65D 35/10; B65D 35/46; B65D 35/36; B65D 39/0052; B65D 47/2018

See application file for complete search history.

(56) References Cited

U.S. PATENT DOCUMENTS

| | | | | |
|---|---|---|---|---|
| 3,165,242 A * | 1/1965 | Jackson | ..... | B65D 35/46 222/495 |
| 3,179,300 A * | 4/1965 | Davidson | ..... | B65D 35/46 222/213 |
| 3,344,963 A * | 10/1967 | Wynes | ..... | B65D 35/46 137/533.13 |
| 8,833,616 B2 * | 9/2014 | Lin | ..... | B65D 47/0871 222/507 |

FOREIGN PATENT DOCUMENTS

| | | |
|---|---|---|
| JP | 2005009506 | 1/2005 |

* cited by examiner

*Primary Examiner* — Frederick C Nicolas
(74) *Attorney, Agent, or Firm* — Isshiki international Law Office; Joseph P. Farrar, Esq.

(57) ABSTRACT

An inner plug mounted to the neck of the flexible container has a cylindrical hollow portion that contains a valve element, a valve seat disposed below the valve element, a permanent magnet disposed below the valve seat that attracts the valve element to the valve seat, and a discharge outlet in the top of the inner plug to allow discharge of fluid contents of the container via a flow path extending from the discharge outlet to the container body via a void formed between the valve element and the valve seat. The valve element is movable between a closed valve state, in which the valve element contacts the valve seat, and the bottom of the discharge outlet. An open valve state is achieved once pressure inside the container overcomes the magnetic attraction of the valve element to the valve seat and forces the valve element away from the valve seat.

6 Claims, 8 Drawing Sheets

INNER PLUG STRUCTURE FOR FLEXIBLE CONTAINER AND FLEXIBLE CONTAINER

CROSS-REFERENCE TO RELATED APPLICATIONS

The present application claims priority pursuant to 35 U.S.C. § 119 to Japanese Patent Application No. 2017-104125 filed on May 26, 2017 in the Japan Patent Office, the entire disclosure of which is herein incorporated by reference.

BACKGROUND

Technical Field

The present disclosure relates to an inner plug structure for a flexible container and a flexible container incorporating the inner plug.

Background Art

A flexible container for storing fluid content, such as liquid or paste, has a cap and a neck portion. The cap or the like mounted to the flexible container in a manner continuous with a container body for storing the fluid. The neck portion has an opening therein as a fluid discharge outlet at its end. The flexible container may be, for example, a squeezable container to contain a paste condiment such as mayonnaise, a tube container to contain toothpaste, or a squeezable bottle to be used as, for example, a water bottle for supplying water during exercise.

SUMMARY

In the flexible container, when the fluid accommodated in the container body is discharged, the container body is squeezed by a human hand or the like, thereby increasing the pressure within the container body to discharge the fluid from the opening at the tip of the neck portion. In the flexible container, such a discharge amount of the fluid is adjusted by making an adjustment to the squeezing force to the container body. In Japanese Patent Application Publication No. 2005-9506, a valve using a magnetic force of a permanent magnet is described in connection with the present sure.

The flexible container that contains a fluid as its contents usually has a cap to prevent leakage and volatilization of the fluid during storage. However, the flexible container, such as a tube container, cannot maintain an upright state in which its fluid discharge outlet is directed vertically upward. Thus, when the fluid is a liquid having a low viscosity and if the container in an opened state is tilted or turned upside down, the fluid leaks out. Even in a bottle-shaped container with a bottom, if the container in the opened state is laid on its side, the fluid leaks out.

Conceivably, a valve may be incorporated as an inner valve in the neck portion of the flexible container that does not require power to open like a solenoid valve does but one using the magnetic force of a permanent magnet as described in the above-mentioned Japanese Patent Application Publication No. 2005-9506. The valve described in Japanese Patent Application Publication No. 2005-9506 is a check valve, and includes a spherical valve element disposed on the upstream side of a flow path of the fluid, such as a gas or liquid. This valve uses the rim of the discharge outlet on the upstream side of the flow path as a valve seat. The valve element is seated against this valve seat to close the valve. When pressure exceeding a threshold value is applied to the valve element upstream to downstream in the flow path, the valve element opens against the attractive magnetic force of the permanent magnet. Such a conventional valve shifts swiftly from the closed state, in which the valve element is pressed against the outlet on the upstream side of the flow path, to the open state, due to the pressure of the fluid.

However, in such a flexible container, assuming that the pressure is adjusted by squeezing the container by hand, the fluid is discharged at a stroke when the pressure exceeds the threshold value, due to the operation of such a responsive valve. Further, since the container body is squeezed by hand, the pressure in the container body varies. Thus, it is difficult to precisely discharge a predetermined amount of the fluid, and a very small amount in particular.

Accordingly, an aspect of the present disclosure is an inner plug structure for a flexible container and a flexible container including the inner plug structure, which includes a valve mechanism capable of reliably preventing leakage of a fluid which is the contents of the container, even if the container in an opened state is laid on its side, as well as capable of precisely discharging a very small amount of the fluid on demand.

Another aspect of the present disclosure is an inner plug structure for a flexible container, the flexible container configured such that a hollow tubular neck portion having its axis in a vertical direction is connected to a container body, the neck portion having an opening at an top thereof, the container body made of a flexible material to contain a fluid therein, the inner plug structure comprising: a tubular inner plug including a hollow portion therein, the hollow portion having its axis in the vertical direction; a valve element made of a material capable of being attracted by a magnetic force, the valve element being accommodated in the hollow portion of the inner plug so as to be movable in the vertical direction; a valve seat to support the valve element from below, in a closed valve state; and a permanent magnet disposed below the valve seat, the inner plug structure being configured to be mounted to the neck portion, wherein the hollow portion of the inner plug opens downward while maintaining a shape of its cross section orthogonal to the axis, as well as the hollow portion has a discharge outlet for the fluid that opens in its top surface on its top side, the discharge outlet having an opening shape included in the shape of the cross section, a planar shape of the valve element when viewed from above is included in the shape of the cross section of the hollow portion while including the opening shape of the discharge outlet, the valve seat includes a recessed portion in its upper surface, the recessed portion having a periphery whose shape is along the planar shape of the valve element, a tubular flow path is formed to open downward extending from an opening provided inside the recessed portion, through a region in which the permanent magnet is disposed, in the closed valve state, a void is formed between the valve element and the upper surface of the recessed portion, while the valve element contacts the periphery of the recessed portion, the valve element is always attracted toward the valve seat by the permanent magnet, and when a pressure equal to or greater than a predetermined value is applied, by the fluid in the container, to a bottom surface of the valve element, an open valve state is brought about, and when the pressure is smaller than the predetermined value, the valve is closed, the predetermined value being greater than an attractive force exerted between the valve element and the valve seat, and in the open valve state, the valve element is movable in a range from a position thereof in the closed valve state to a position thereof when contacting the inner periphery of the discharge outlet.

In the inner plug structure for a flexible container, it is preferable that the inner plug includes a cylindrical hollow portion therein, the hollow portion having its axis in the vertical direction, the valve element has a spherical shape, the permanent magnet is disposed around a circle concentrically with respect to the inner plug, the hollow portion of the inner plug opens downward while maintaining its internal diameter, and the hollow portion has a discharge outlet for the fluid that opens in its top surface on its top side, the discharge outlet having an opening diameter smaller than an internal diameter of the hollow portion, the valve element has a diameter greater than the opening diameter of the discharge outlet, and smaller than the internal diameter of the hollow portion, the valve seat includes a recessed portion having a circular periphery in its upper surface, the tubular flow path opens downward extending from an opening at a center of the recessed portion, through a hollow portion in which the annular permanent magnet is disposed, in the closed valve state, a void is formed between the valve element and the upper surface of the recessed portion, while the valve element contacts the circular periphery of the recessed portion concentrically.

Further, the inner plug structure for a flexible container can be such that the flow path is formed such that a hollow tubular shaft portion is connected to the bottom surface of the valve seat, the shaft portion opening downward while being inserted into the hollow portion in the permanent magnet, and the opening at the center of the recessed portion is connected to a hollow portion of the shaft portion.

The inner plug structure for a flexible container may be such that the permanent magnet is disposed below the valve seat, in a sealed state.

The present disclosure includes a flexible container configured such that a hollow tubular neck portion having its axis in a vertical direction is connected to a container body, the container body made of a flexible material to contain a fluid therein, the neck portion having an opening at an top thereof, and in an aspect of the flexible container according to the present disclosure, the inner plug structure is configured to be mounted to the neck portion, the inner plug structure includes a tubular inner plug including a hollow portion therein, the hollow portion having its axis in the vertical direction, a valve element made of a material capable of being attracted by a magnetic force, the valve element being accommodated in the hollow portion of the inner plug so as to be movable in the vertical direction, a valve seat to support the valve element from below, in a closed valve state, and a permanent magnet disposed below the valve seat, wherein the hollow portion of the inner plug opens downward while maintaining a shape of its cross section orthogonal to the axis, as well as the hollow portion has a discharge outlet for the fluid that opens in its top surface on its top side, the discharge outlet having an opening shape included in the shape of the cross section, a planar shape of the valve element when viewed from above is included in the shape of the cross section of the hollow portion while including the opening shape of the discharge outlet, the valve seat includes a recessed portion in its upper surface, the recessed portion having a periphery whose shape is along the planar shape of the valve element, a tubular flow path is formed to open downward extending from an opening provided inside the recessed portion, through a region in which the permanent magnet is disposed, in the closed valve state, a void is formed between the valve element and the upper surface of the recessed portion, while the valve element contacts the periphery of the recessed portion, the valve element is always attracted toward the valve seat by the permanent magnet, and when a pressure equal to or greater than a predetermined value is applied, by the fluid in the container, to a bottom surface of the valve element, an open valve state is brought about, and when the pressure is smaller than the predetermined value, the valve is closed, the predetermined value being greater than an attractive force exerted between the valve element and the valve seat, and in the open valve state, the valve element is movable in a range from a position thereof in the closed valve state to a position thereof when contacting the inner periphery of the discharge outlet.

Further, the flexible container can be such that the inner plug includes a cylindrical hollow portion therein, the hollow portion having its axis in the vertical direction, the valve element has a spherical shape, the permanent magnet is disposed around a circle concentrically with respect to the inner plug, the hollow portion of the inner plug opens downward while maintaining its internal diameter, and the hollow portion has a discharge outlet for the fluid that opens in its top surface on its top side, the discharge outlet having an opening diameter smaller than an internal diameter of the hollow portion, the valve element has a diameter greater than the opening diameter of the discharge outlet, and smaller than the internal diameter of the hollow portion, the valve seat includes a recessed portion having a circular periphery in its upper surface, the tubular flow path opens downward extending from an opening at a center of the recessed portion, through a hollow portion in which the annular permanent magnet is disposed, in the closed valve state, a void is formed between the valve element and the upper surface of the recessed portion, while the valve element contacts the circular periphery of the recessed portion concentrically.

DETAILED DESCRIPTION

Figures 1A, 1B, 1C:
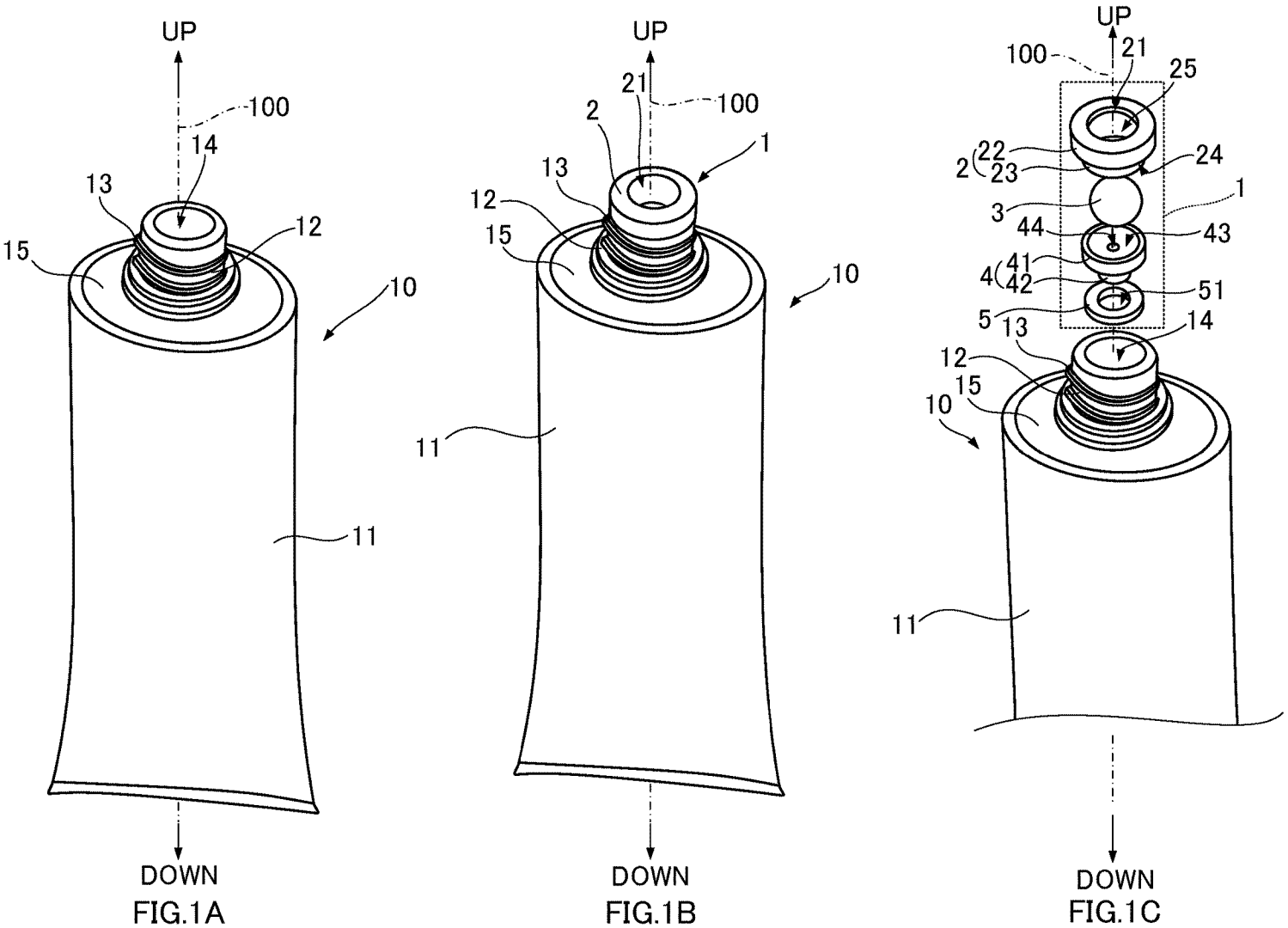
FIGS. 1A to 1C are schematic diagrams illustrating an inner plug structure for a flexible container according to an embodiment of the present disclosure.

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

Embodiments of the present disclosure will be described below with reference to the accompanying drawings. In the drawings used for the following description, components that are the same or similar are given the same reference numerals and the descriptions thereof may be omitted. Reference numerals unnecessary in making descriptions may also be omitted depending on the drawings.

An inner plug structure for a flexible container according to an embodiment of the present disclosure is fitted in a neck portion of a tube container for storing a fluid made of a cosmetic agent (cosmetic lotion, oil, emulsion, etc.), and acts as a check valve. FIGS. 1A to 1C illustrate a tube container 10 including an inner plug structure 1 according to an embodiment of the present disclosure. FIG. 1A is an external view illustrating the tube container 10 in a state in which the inner plug structure 1 is not mounted therein. FIG. 1B is an external view illustrating the tube container in a state in which the inner plug structure 1 is mounted therein. FIG. 1C is a diagram obtained by disassembling the inner plug structure 1, which is mounted to a neck portion 12 of the flexible container 10, into its individual components.

As illustrated in FIG. 1A, in the tube container 10, a container body 11 to contain a fluid is made of a thin-walled resin material that is easily deformable by hand. For example, the container body 11 is formed of a resin material having a single-layer structure made of polyethylene (PE) or the like, or a multilayer structure in which PE is coated with a resin such as ethylene-vinyl alcohol polymer (EVOH) or the like. Alternatively, the container body 11 may be made of a material having a layer of metal such as aluminum. When the tube container 10 is intended for a cosmetic agent, a resin material such as PE, polypropylene (PP), and PET can also be considered. Then, external threads 13 are formed around outside of the hollow tubular neck portion 12 which is continuous with this container body 11, and a removable cap (not shown) is attachable to the neck portion 12.

An opening 14 in the top of the neck portion 12 is the fluid discharge outlet of the flexible container 10, and communicates with the inside of the container body 11 via the hollow interior portion of the neck portion 12. The container body 11 and the neck portion 12 may be integrally molded as a single integrated unit, or individually molded as separate components. The illustrated tube container 10 is constituted by the container body 11 and a molded portion in which the neck portion 12 and a shoulder portion 15 are a single integrated unit. The molded portion composed of the neck portion 12 and the shoulder portion 15 has larger wall thicknesses than the container body 11, but the material thereof can be made of the same material as that of the container body 11.

A procedure for manufacturing the tube container 10 involves, for example, molding a hollow cylindrical sleeve, which ends up as the container body 11, by extrusion molding or bonding of sheets; and by injection-molding forming in one end of the sleeve the single integrated unit composed of the shoulder portion and the neck portion. Then, the contents are injected from the other end of the sleeve, and this other end is sealed by welding, bonding, or the like, so that the tube container 10 filled with the contents is completed. Alternatively, the tube container 10 may be manufactured by joining the container body 11 and the aforementioned single integrated unit composed of the neck portion 12 and the shoulder portion 15 by ultrasonic welding, bonding, or the like.

The inner plug structure 1 according to an embodiment of the present disclosure includes, as illustrated in FIG. 1B, an inner plug 2 which is mounted in the opening 14 of the neck portion 12. Specifically, the inner plug structure 1 includes, as illustrated in FIG. 1C, the inner plug 2, a spherical valve element 3, a valve element support member 4 including a disc-shaped valve seat 41 that supports the valve element 3 from below in a closed valve state, and an annular permanent magnet 5. The inner plug 2 and the valve element support member 4 constitute a single integrated unit made of resin, and can be a molded product made of PE, PP, or silicone, for example. Further, the valve element 3 is configured as a stainless steel ball because the fluid is a cosmetic lotion which for human skin. Such stainless steel balls are commonly used as stirring balls or the like for a cosmetic agent container. In the present embodiment, a stainless steel ball made of SUS 400, which is capable of being attracted to a magnet, is used.

Here, each of the relative upward direction and downward direction in an vertical direction in the tube container 10 and the inner plug structure 1 is defined, assuming that the vertical direction is the direction of an axis 100 of the hollow cylindrical neck portion 12 and the top side is the side on which the opening 14 of the tube container 10 is positioned in the neck portion 12. Further, in a state in which the inner plug structure 1 is mounted to the neck portion 12, the components (2 to 5) constituting the inner plug structure 1 are disposed coaxially with the neck portion 12. In the following description, in addition to the relative vertical direction, an upward direction and a downward direction based on gravity will be referred to as vertically upward and vertically downward separately from the above.

When the relative vertical direction is defined as described above, the inner plug 2 has a tiered hollow cylindrical shape in which a cylindrical body portion having a diameter smaller than a flat cylindrical head portion 22 is connected to the lower side of the head portion 22, and a fluid discharge outlet 21 in the inner plug structure 1 is disposed in the center of the top of the head portion 22. The valve element support member 4 is formed such that a cylindrical shaft portion 42 is connected to the lower side of the valve seat 41 that supports the spherical valve element 3 from below. In the upper surface of the valve seat 41, a recessed portion 43 having a circular periphery and a conical inner surface is formed. In the center of the recessed portion 43, a through-hole 44 extending to the bottom of the shaft portion 42 is formed. Then, the annular permanent magnet 5 is fitted around the shaft portion 42 of the valve element support member 4. It should be noted that although a common magnet such as a ferrite magnet can be used as the permanent magnet 5, in the present embodiment a neodymium magnet having a strong magnetic force is used.

In a state in which the inner plug structure 1 is mounted to the tube container 10, in the inner plug structure 1 according to the present embodiment, a bottom surface 24 of the head portion 22 of the inner plug 2 contacts a top surface of the neck portion 12. In this state, only the head portion 22 of the inner plug 2 is exposed outside the neck portion 12, while the body portion 23 of the inner plug 2, the valve element support member 4, and the permanent magnet 5 below the head portion 22 are inserted into the neck portion 12. Further, the spherical valve element 3 is accommodated within a hollow portion 25 of the inner plug 2.

Figure 2B:
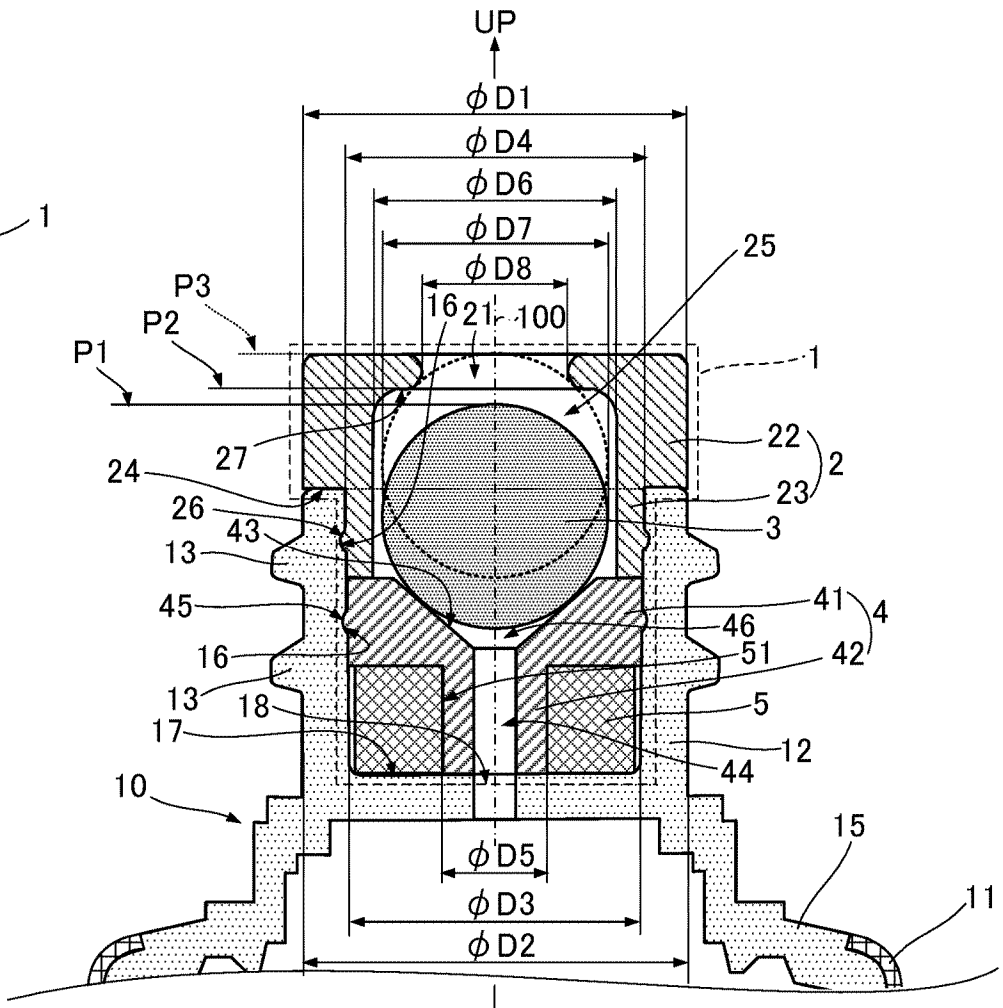
FIGS. 2A and 2B are diagrams illustrating a structure of an inner plug structure for a flexible container according to an embodiment of the present disclosure.
Figure 2A:
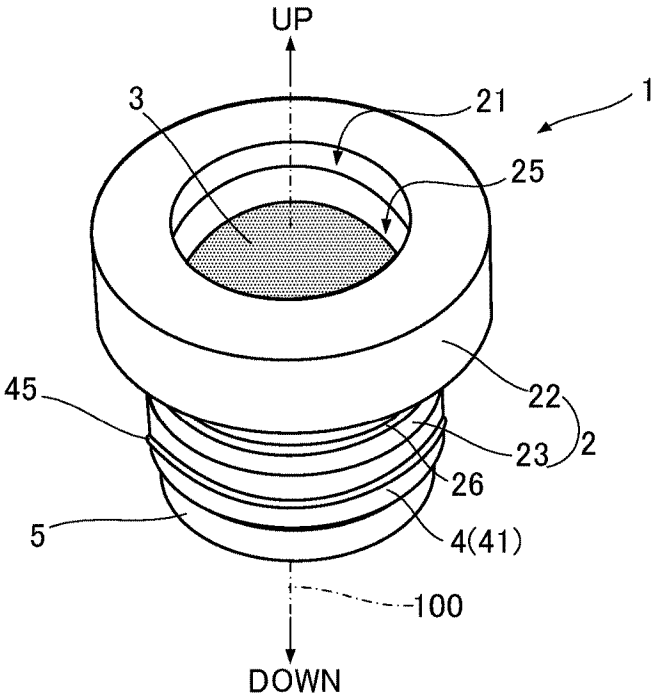

FIGS. 2A and 2B illustrate a structure of the inner plug structure 1 according to an embodiment of the present disclosure. FIG. 2A is an external view illustrating the inner plug structure 1 in its assembled state. FIG. 2B is a longitudinal sectional view when the inner plug structure 1 mounted to the neck portion 12 of the tube container 10 is cut along a face including the vertical direction. As illustrated in FIG. 2A, in the inner plug structure 1, the disc-shaped valve seat 41 in the valve element support member 4 is coaxially laminated to the lower side of the two-tier cylindrical inner plug 2. In this embodiment, the bottom of the body portion 23 of the inner plug 2 and the top of the valve seat 41 in the valve element support member 4 are joined to each other by welding, bonding, or the like. The annular permanent magnet 5 is fitted around the shaft portion of the valve element support member 4. Then, the hollow portion 25 of the inner plug 2 accommodates the spherical valve element 3. In the illustrated inner plug structure 1, annular projections (26, 45) are formed on the outside of the body portion 23 of the cylindrical inner plug 2 and the disc-shaped valve seat 41, respectively.

Next, the components and structure of the inner plug structure 1 according to an embodiment of the present disclosure will be described more specifically with reference to FIG. 2B. FIG. 2B illustrates the tube container 10 and the components (2 to 5) constituting the inner plug structure 1 using different hatch patterns. An external diameter φD1 of the head portion 22 in the inner plug 2 is equal to an external diameter φD2 of the neck portion 12 in the tube container 10. The body portion 23 having an external diameter φD4 equal to or slightly larger than an internal diameter φD3 of the neck portion 12 is connected to the lower side of the head portion 22. The valve seat 41 of the valve element support member 4 has an external diameter equal to the external diameter φD4 of the body portion 23. Thus, the body portion 23 of the inner plug 2 and the valve seat 41 of the valve element support member 4 are fitted together and inserted into the neck portion 12.

The hollow tubular shaft portion 42 having a diameter smaller than the valve seat 41 is formed under the valve seat 41 of the valve element support member 4. An external diameter φD5 of the shaft portion 42 is equal to or slightly larger than an internal diameter of a hollow portion 51 in the annular permanent magnet 5. Accordingly, the permanent magnet 5 is fitted around the shaft portion 42 in a fitted state. It should be noted that two recessed portions 16 around the axis 100 are formed, at two upper and lower positions, on the inner surface of the neck portion 12 in the tube container 10. The projections (26, 45) respectively formed on the side surfaces of the body portion 23 and the valve seat 41 engage these recessed portions 16 a so that the inner plug structure 1 mounted to the neck portion 12 is not easily removed. Alternatively, the inner plug structure 1 may be mounted to the neck portion 12 by welding or bonding.

As illustrated in FIG. 1C, the recessed portion 43 having a circular periphery is formed in the upper surface of the valve seat 41, and the through-hole 44 formed in the center of this recessed portion 43 extends to the bottom of the shaft portion 42 via the hollow portion of the shaft portion 42. A hole 18 communicating with the inside of the container body 11 is formed in the center of a bottom surface 17 of the cylindrical inner surface in the neck portion 12. Accordingly, a tubular flow path is formed to communicate from the bottom of the shaft portion 42 via the hollow portion 51 of the annular permanent magnet 5 to the center of the recessed portion 43 that is formed in the upper surface of the valve seat 41, so that the fluid in the container body 11 is guided, via the flow path, into the inner plug structure 1.

As noted above, the spherical valve element 3 is accommodated within the hollow portion 25 of the inner plug 2. A diameter φD7 of the valve element 3 is larger than an opening diameter φD8 of the discharge outlet 21 in the inner plug 2, and is smaller than an internal diameter φD6 of the hollow portion 25 in the inner plug 2. Further, in the inner plug structure 1, the valve is closed by causing the valve element 3 to contact the circular periphery of the recessed portion 43 of the valve seat 41 concentrically. In the present embodiment, the valve element 3 contacts the inner surface of the recessed portion 43. Alternatively, the valve element 3 may be made to contact the periphery of the recessed portion 43. In the closed valve state, a top position P1 of the valve element 3 is lower than a vertical position P2 of a top surface 27 in the hollow portion 25 of the inner plug 2. Thus, the valve element 3 is movable in the vertical direction in a range between a position P3 as its upper limit of movement, at which the valve element 3 contacts the inner rim of the discharge outlet 21 as indicated by a dotted circle in the drawing, and the position P1 in the closed valve state.

In the inner plug structure 1, the valve element 3 comes in contact with the inner surface of the recessed portion 43 by an attractive force from the permanent magnet 5, which brings about the closed valve state. When the valve element 3 is biased to the discharge outlet 21 side by a force greater than the attractive force from the permanent magnet 5, the valve element 3 and the periphery of the recessed portion 43 of the valve seat 41 are separated, thus opening the valve. In the open valve state, since the internal diameter φD6 of the hollow portion 25 in the inner plug 2 is greater than the diameter φD7 of the valve element 3, a fluid discharge path is formed from the inside of the container body 11 to the discharge outlet 21 of the inner plug 2.

Note that the recessed portion 43 in the valve seat 41 is formed such that a void 46 is created between the upper surface of the recessed portion 43 in the upper surface of the valve seat 41 and the lower surface of the valve element 3 when the valve is closed by contact between the spherical valve element 3 and the inner surface of the recessed portion 43. Further, the valve element 3 is always attracted downward by the magnetic force of the permanent magnet 5. Thus, the closed valve state is maintained such that the valve element 3 is stuck to the valve seat 41 by the magnetic force of the permanent magnet 5, as long as no pressure equal to or greater than a predetermined value is applied thereagainst upward from below. When pressure equal to or greater than the predetermined value is applied against the lower surface, the valve element 3 can be moved only within the aforementioned range between the positions P1 and P3 described above. That is, the vertical position P2 of the top surface 27 of the hollow portion 25 and the opening diameter φD8 of the discharge outlet 21 are dimensioned such that, if the pressure applied upward onto the valve element 3 from below is smaller than the predetermined value, the valve element 3 is stuck to the valve seat 41 so that the valve is closed. Further, in addition preventing the valve element 3 from deviating, as a stopper of the valve element 3 the inner plug 2 also functions to facilitate discharging a very small amount of a fluid, with the vertical position P2 of the top surface 27 and the opening diameter φD8 of the discharge outlet 21 dimensioned accordingly.

Operation of Inner Plug Structure

The inner plug structure according to the present embodiment is operated, by virtue of the above-described components and structure, such that the closed valve state is maintained as long as no pressure equal to or greater than the predetermined value is applied upward against the valve element. Moreover, even in a case in which pressure equal to or greater than the predetermined value is applied and the open valve state is brought about, the valve quickly returns to the closed valve state once the pressure applied against the valve element becomes smaller than the predetermined value. Accordingly, even if the tube container in its opened state is laid on its side, the fluid content does not leak out, and when the body of the tube container is squeezed, a very small amount of the fluid can be precisely discharged.

Figure 3A:
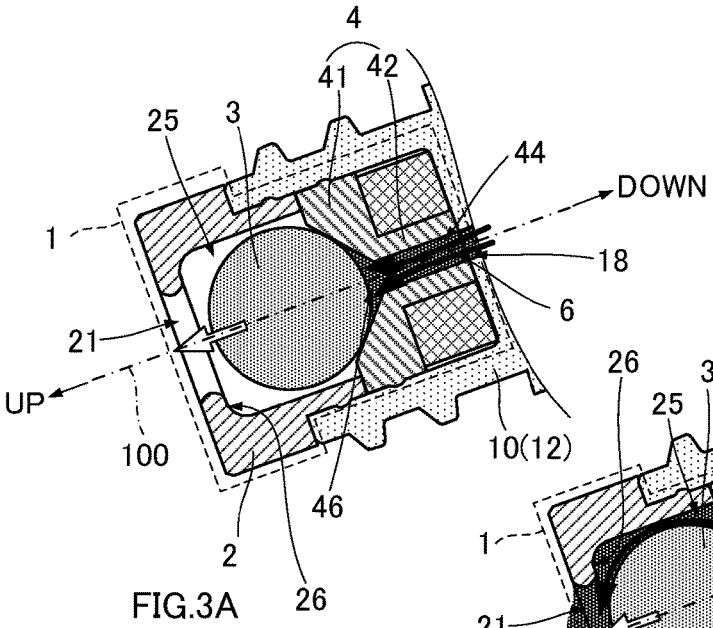
FIGS. 3A to 3D are diagrams illustrating an operation of an inner plug structure for a flexible container according to an embodiment of the present disclosure.

FIGS. 3A to 3D illustrate operation of the inner plug structure 1 according to an embodiment of the present disclosure. First, the tube container is inverted or inclined such that the discharge outlet 21 of the inner plug 2 is directed vertically downward or inclined with respect to a vertically downward direction, and the container body of the tube container is squeezed. This causes fluid 6 to flow into the inner plug structure 1. At this time, since the aforementioned void 46 exists between the upper surface of the recessed portion 43 of the valve seat 41 and the valve element 3, the valve element 3 is not biased toward the discharge outlet 21 until this void 46 is filled with the fluid 6 (FIG. 3A).

Figure 3B:
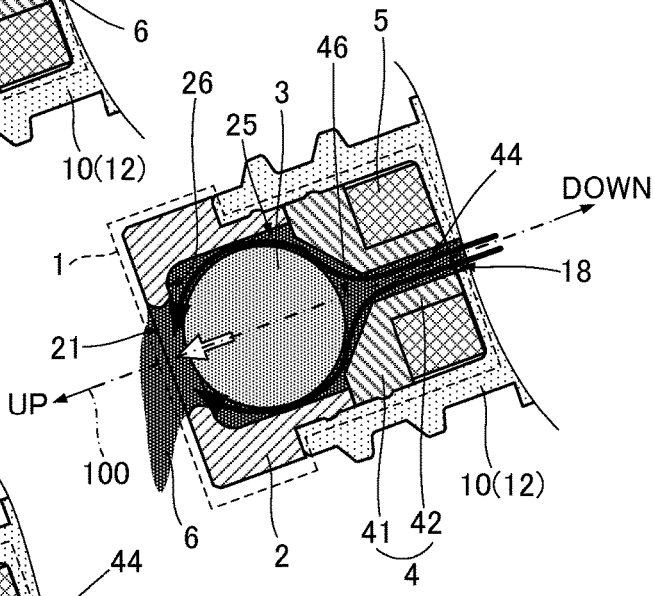
Figure 3C:
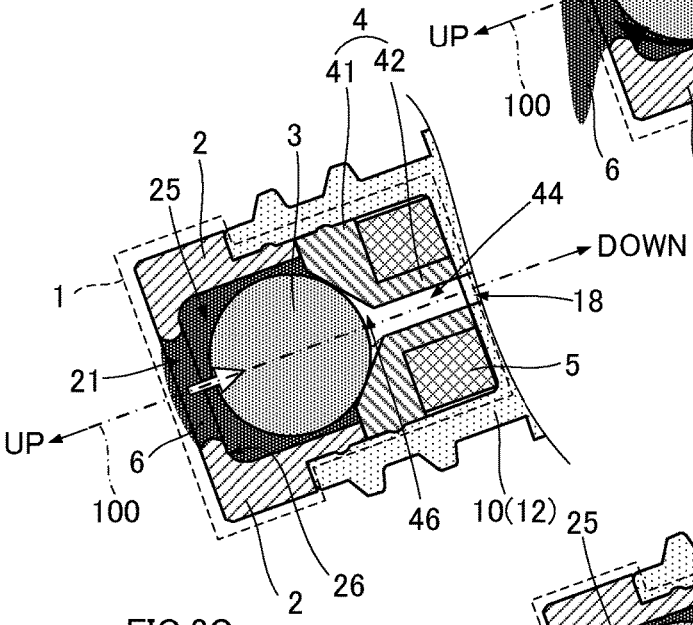

When the container body is continuously squeezed and pressure equal to or greater than the predetermined value is applied against the valve element 3 by the fluid 6, the valve element 3 floats free of the valve seat 41 against the attractive force by the permanent magnet 5. At this time, a fluid discharge path forms, so that the fluid 6 reserved in the aforementioned void of the recessed portion 43 runs out between the valve element 3 and the inner surface of the hollow portion 25 in the inner plug 2 to flow into the discharge outlet 21 and is discharged from the discharge outlet 21 (FIG. 3B). Further, even when the valve element 3 is separated from the valve seat 41, the valve element 3 returns to the valve seat 41 side due to the attractive force of the permanent magnet 5 once the pressure applied against the valve element 3 from inside the container becomes smaller than the predetermined value, so that the inner plug structure 1 is closed (FIG. 3C). It should be noted that the pressure applied against the valve element 3 is generated by a user squeezing the body of the tube container, and thus, in practice, the pressure is slightly released the moment the valve opens. Accordingly, the pressure applied against the valve element 3 instantly becomes smaller than the predetermined value, and the valve element 3 is attracted by the magnetic force of the permanent magnet, so that the valve is closed.

Figure 3D:
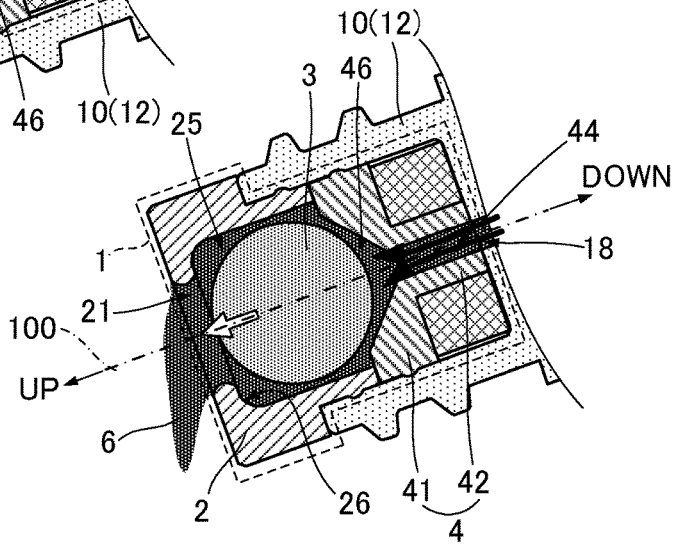

The amount of discharge of the fluid 6 in the sequence of this operation of opening and closing the inner plug structure 1 is a very small amount that is determined by the amount of the fluid 6 reserved within the void 46 in the recessed portion 43 at the start of a valve opening operation, and the amount of the fluid 6 that has flowed into the inner plug 2 in the short space of time until the valve element 3 contacts the inner rim of the discharge outlet 21 in the inner plug 2 and the fluid discharge path is closed. Further, when the container body is continuously squeezed, the inner plug structure 1 repeats the valve opening operation by the pressure of the fluid 6 and the valve closing operation by the release of the pressure associated with the valve opening (FIG. 3D). As such, a very small amount of the fluid 6 is discharged.

It should be noted that, even with fluid having the same viscosity, appropriate setting of a difference between the internal diameter φD6 of the hollow portion in the inner plug 2 and the diameter φD7 of the valve element 3 illustrated in FIGS. 3A to 3D, or the magnetic force of the permanent magnet 5, can prevent the fluid 6 from being discharged from the discharge outlet 21 in a single operation of opening and closing the plug, by surface tension. In this case, in a process of continually pressing the container body and continually performing the operation of opening and closing the plug, the fluid 6 accumulated on the discharge outlet 21 side is discharged at the point when the accumulated fluid's own weight exceeds its surface tension. That is, in the inner plug structure 1 according to the present embodiment, it is possible to intermittently drip a very small amount as well as a predetermined amount of the fluid 6 by appropriately setting the sizes of the components and/or the magnetic force of the permanent magnet.

As such, in the inner plug structure 1 according to the present embodiment, it is possible to precisely discharge a very small amount of the fluid 6 without the need to finely adjust the force of squeezing the container body of the flexible container. Further, by appropriately setting the magnetic force of the permanent magnet 5 and the dimensions (φD2 to φD8, etc.) of the components (2 to 4) constituting the inner plug structure 1 illustrated in FIGS. 3A to 3D, it is possible to control a mode of discharge, such as discharge speed, discharge amount, or dripping of the fluid 6.

There may be a case in which different fluids are contained in flexible containers having the same shape. Alternatively, there may be another case in which, even if the same fluid is contained in flexible containers having the same shape, variations in the mode of discharge (dripping, continuous discharging, etc.) are desired depending on the use of the fluid. In such cases, when adjusting the magnetic force of the permanent magnet 5 in addition to the size of the components, it is necessary to prepare the various permanent magnets 5 having the same shape but different magnetic forces. However, the permanent magnet 5 is expensive among the components constituting the inner plug structure 1, which results in increase in the manufacturing cost. The inner plug structure 1 according to an embodiment of the present disclosure, however, has a structure in which the annular permanent magnet 5 is disposed below the valve seat 41 of the valve element support member 4. Thus, the attractive force affecting the valve element 3 can be adjusted by changing the distance in the vertical direction between the valve element 3 and the permanent magnet 5 in the closed valve state, using the valve seats 41 having different thicknesses, which the permanent magnet 5 is disposed in contact with.

Other Embodiments

The external shape of the inner plug structure is not necessarily cylindrical as long as the hollow portion of the inner plug to accommodate the spherical valve element is cylindrical. The external shape of the inner plug structure may be any shape as long as it engages the inner surface of the neck portion. Further, the inner plug does not necessarily have a tiered tubular shape, as long as a discharge outlet for a fluid is formed in the top. Thus, the entire inner plug structure may be inserted in the neck portion.

The inner plug structure may be configured to be removable from the neck portion. That is, the inner plug structure may be provided as a single body separate from the flexible container. Accordingly, for example, if a plurality of inner plug structures having different states of discharge is prepared for a given flexible container, a user can select an appropriate inner plug structure depending on the type of a fluid and/or the use of the flexible container, and mount it to the neck portion of the flexible container.

In the embodiment described above, in order to prevent a fluid from contacting the permanent magnet, the shaft portion of the valve seat is inserted into the hollow portion of the annular permanent magnet, and a through-hole serving as a flow path for such contents is formed in the shaft portion. Alternatively, the valve element support member may be constituted only by the valve seat and the hollow portion of the annular permanent magnet may be used as a part of the flow path of the fluid, as long as the fluid is a material that does not cause a problem even if contacting the surface of the permanent magnet, or the surface of the permanent magnet is coated with a film that does not cause a chemical reaction even if contacting the fluid and the film does not easily wear out or peel off. Conversely, contact between the permanent magnet and the fluid may be prevented altogether.

Figure 4A:
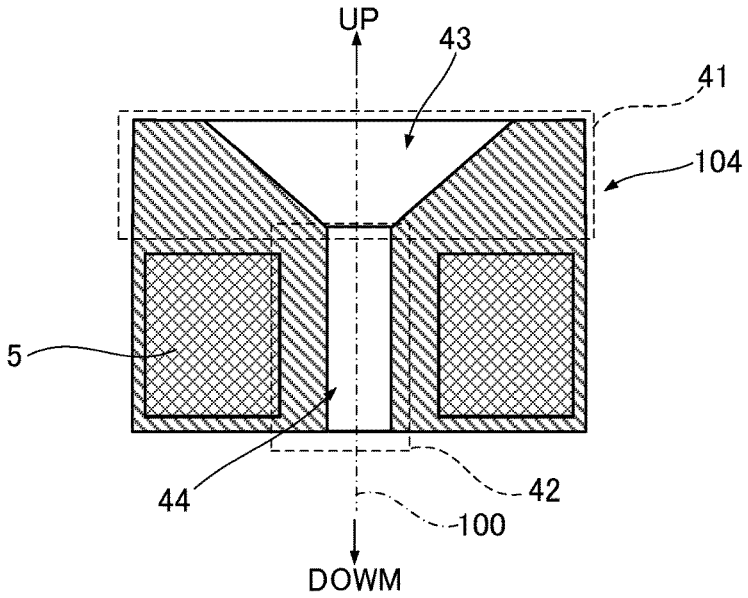
FIGS. 4A and 4B are diagrams illustrating deformations of a valve element support member constituting an inner plug structure for a flexible container according to an embodiment of the present disclosure.
Figure 4B:
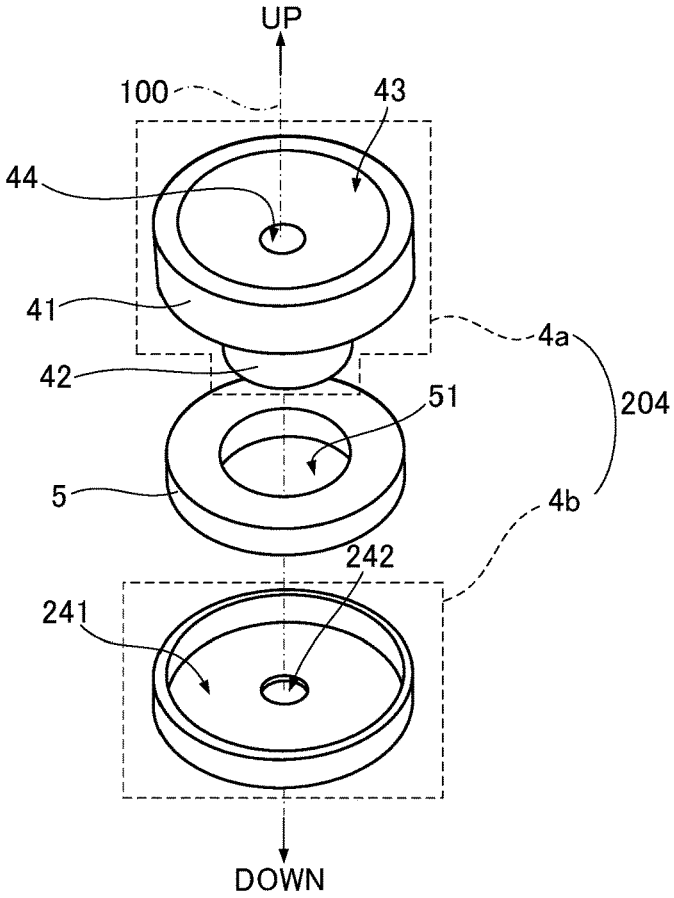

The embodiment described above has a structure in which the fluid in the container body 11 does not easily contact the permanent magnet 5 directly since the bottom surface 17 of the neck portion 12 serves as a partition, as illustrated in FIGS. 2A and 2B. However, a structure may be provided in which the inner plug structure itself is able to prevent contact between the permanent magnet and the fluid more reliably. FIGS. 4A and 4B illustrate the valve element support member (104, 204) including a structure capable of prevent contact between the permanent magnet 5 and the fluid more reliably. In the valve element support member 104 illustrated in FIG. 4A in a longitudinal sectional view, a molding technique is used to cover the top surface, the bottom surface, and the peripheral side-surface of the permanent magnet 5, and all of the inner surface of the hollow portion 51 with a resin constituting the valve element support member 104.

Figure 5:
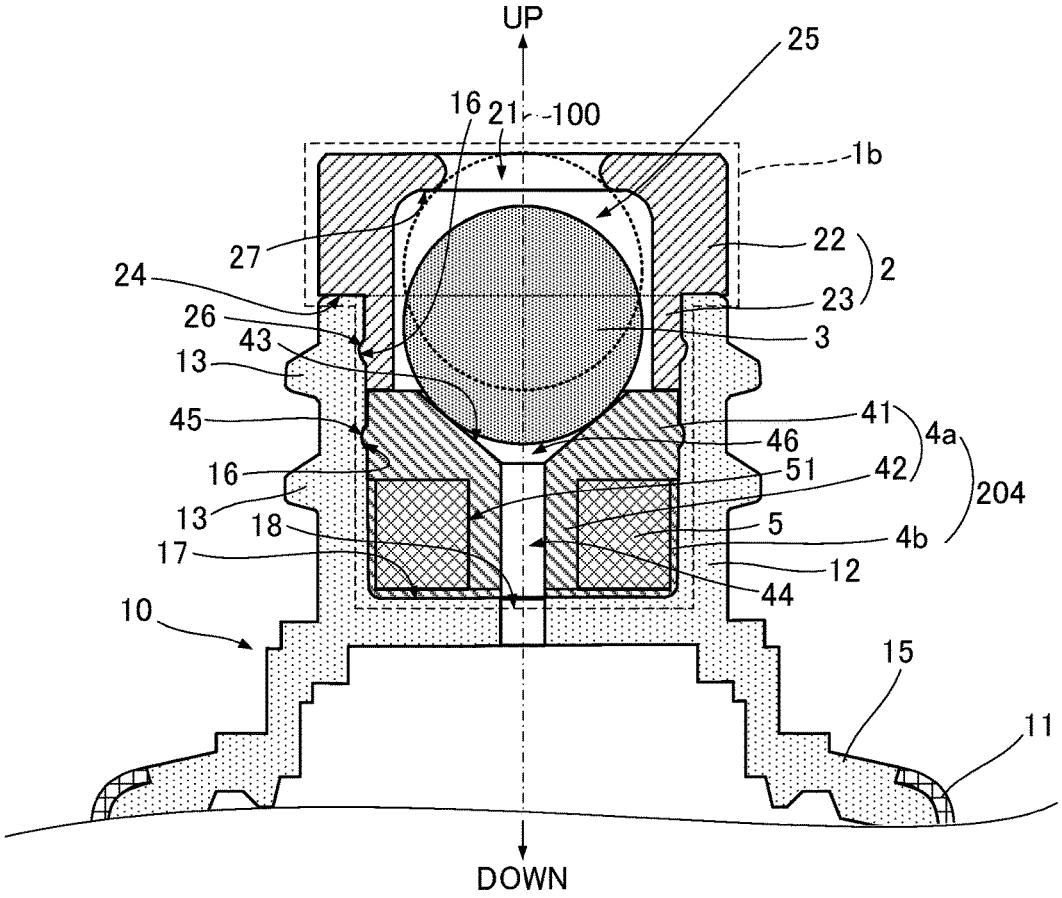
FIG. 5 is a diagram illustrating an example of a flexible container attached with an inner plug structure for a flexible container including a valve element support member according to a deformation of the present disclosure.

Further, the valve element support member 204 illustrated in FIG. 4B in an exploded view includes an upper member 4*a* similar to the valve element support member 4 as in the above embodiment, and a flat bottomed cylindrical lower member 4*b* having an inner diameter substantially equal to the external diameter of the annular permanent magnet 5. An opening 242 having the same diameter as that of the through-hole 44 is formed in the center of a bottom surface 241 of the lower member 4*b*. Then, the bottom rim of the valve seat 41 in the upper member 4*a* and the top rim of the lower member 4*b* are bonded together while the permanent magnet 5 is accommodated within the lower member 4. Accordingly, all the surfaces of the permanent magnet 5 are covered with the valve element support member 204. In addition, the shaft portion 42 need not be formed on the bottom surface of the valve seat 41 of the upper member 4*a*, but instead, a hollow cylindrical portion corresponding to the shaft portion 42 may be formed at the center of the bottom surface 241 of the lower member 4*b*. In either case, contact between the permanent magnet 5 and the fluid 6 can be reliably prevented, as long as the permanent magnet 5 is disposed below the valve seat 41 in a sealed state. FIG. 5 illustrates an inner plug structure 1*b* including the valve element support member 204 illustrated in FIG. 4B. FIG. 5 illustrates a state in which the inner plug structure 1*b* is mounted to the neck portion 12 of the tube container 10.

Figure 6:
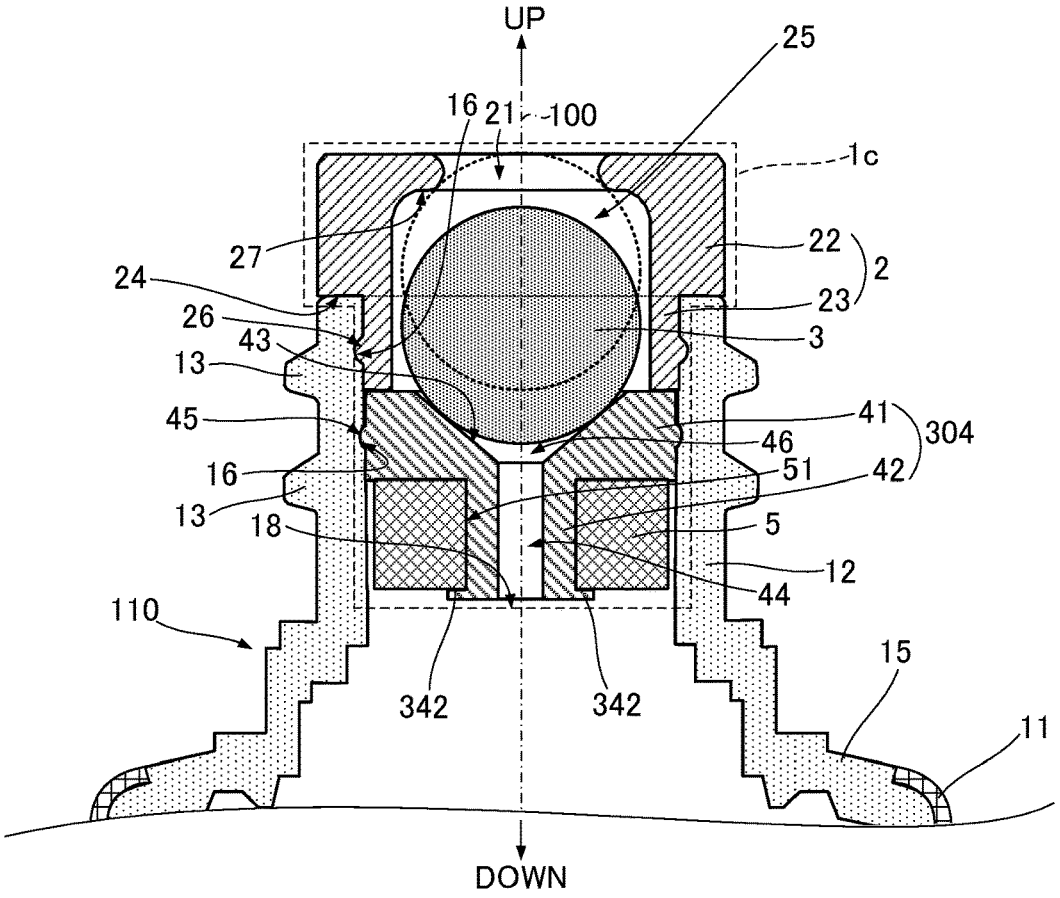
FIG. 6 is a diagram illustrating an example of a flexible container attached with an inner plug structure for a flexible container according to another embodiment of the present disclosure.

FIG. 6 illustrates an example of the inner plug structure when the bottom surface serving as a partition is not provided to the neck portion of the tube container and the contact between the permanent magnet and a fluid does not cause a problem. In this tube container 110 illustrated in FIG. 6, a cylindrical hollow portion in the neck portion 12 communicates with the interior of the shoulder portion 15, while maintaining its circular cross-sectional shape. Further, in a valve element support member 304 in an inner plug structure 1*c* illustrated here, a flange-shaped projection 342, which supports the permanent magnet 5 from below, is formed in the bottom of the shaft portion 42 so as to prevent the permanent magnet 5 from falling off.

Figure 7:
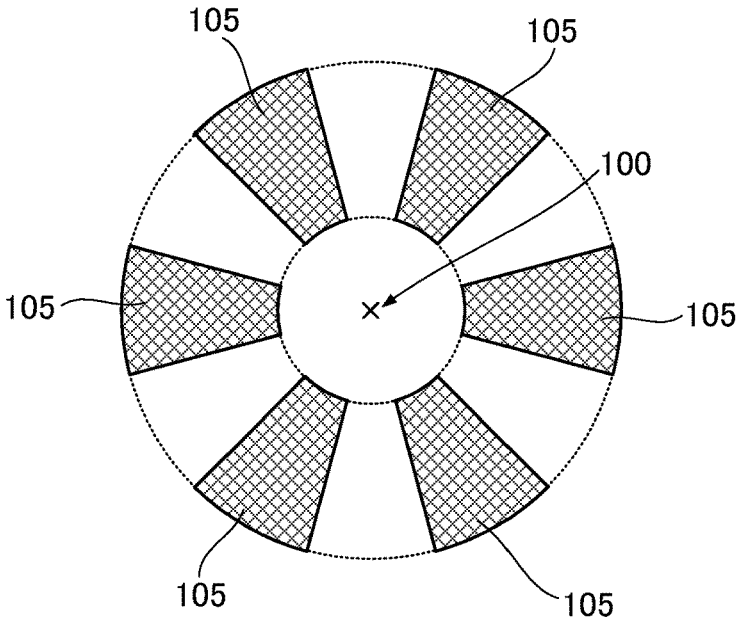
FIG. 7 is a diagram illustrating a modification of a permanent magnet constituting an inner plug structure for a flexible container according to an embodiment of the present disclosure.

The permanent magnet need not have an integral annular shape as long as it is disposed so as to isotropically attract the spherical valve element. For example, as illustrated in FIG. 7, a plurality of permanent magnets 105 each having a fan-like shape may be disposed at equal angular intervals around a circle, when viewed along the vertical direction.

The inner plug structure according to embodiments of the present disclosure is applicable not only to a tube container but to flexible containers having various shapes as well, such as bottles.

Further, the inner plug structure according to embodiments of the present disclosure described above is mounted to the neck portion of the flexible container, such that the body portion of the inner plug and the valve seat of the valve element support member are inserted into the neck portion, while the inner plug structure uses the bottom surface (17 in FIG. 2B) of the neck portion of the flexible container as its seat. It is a matter of course that a structure for mounting an inner plug structure to a neck portion of a flexible container can be changed as appropriate.

FIGS. 8A to 8D illustrate some examples of a mounting structure for the inner plug structure. Here, inner plug structures 1*d* to 1*f*, each mounted to the neck portion 12, are illustrated with the upper side thereof shown enlarged. In the inner plug structure 1*d* illustrated in FIG. 8A, an inner plug 102 is a so-called "overlaid type", in which the inner plug 102 including the discharge outlet 21 for a fluid in its top surface does not have a tiered cylindrical shape but instead has a shape in which a flange 122 is formed in the top face of a cylindrical body portion 123 of the inner plug 102. The body portion 123 is fitted in the neck portion 12 such that the bottom face of the flange 122 is supported from below by the top face of the neck portion 12 in the flexible container 10.

Figure 8A:
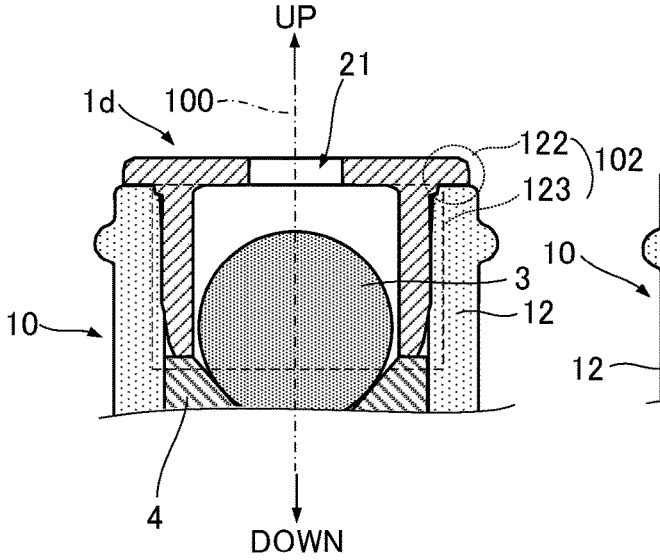
FIGS. 8A to 8D are diagrams illustrating structures of fixing an inner plug structure for a flexible container according to another embodiment of the present disclosure.
Figure 8B:
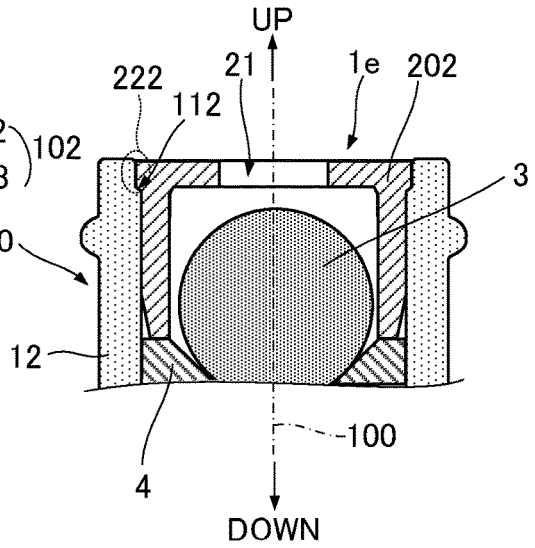

The inner plug structure 1*e* illustrated in FIG. 8B is a "buried type", in which the whole of an inner plug 202 is buried inside the neck portion 12. In this example, the upper edge of the neck portion 12 is formed thinner to form a step 112. Then, a projection 222 that is seated on the step 112 is formed in the top rim of the inner plug 202.

Figure 8C:
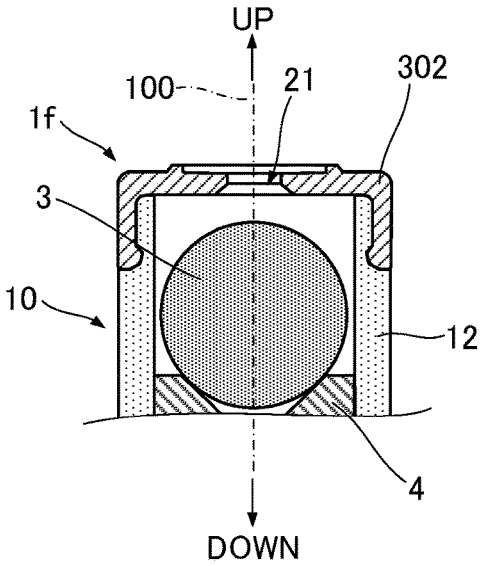
Figure 8D:
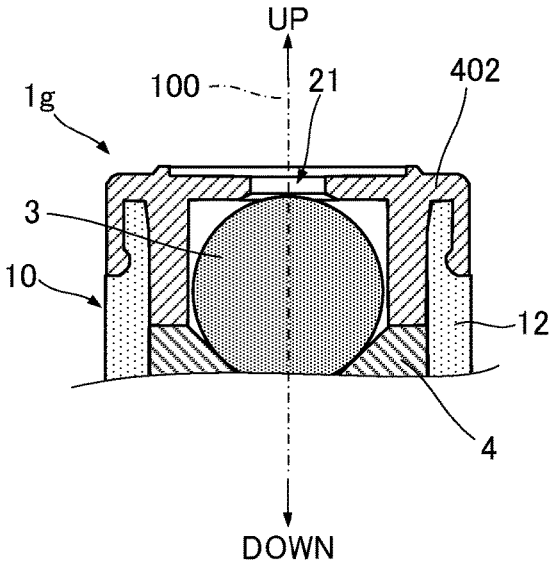

In an inner plug structure 1*f* illustrated in FIG. 8C, an inner plug 302 is an "outer cover type" that is fitted around the top rim of the neck portion 12. It should be noted that, in this outer cover type, the inner plug 302 does not directly contact the valve element support member 4, and the inner plug 302 and the valve element support member 4 are individually mounted to the neck portion 12 separately. That is, the inner plug structure according to this embodiment is not an integral type. Then, an inner plug structure 1*g* illustrated in FIG. 8D has a so-called "outer and inner cover type" structure, that is, the inner plug 402 is mounted to the neck portion 12 in a double tubular shape in which an inner plug 402 sandwiches the upper edge of the neck portion 12 from its inside and outside.

In the embodiments described above, the valve element has a spherical shape, and the valve seat supports the spherical valve element, from below in a cone-shaped recessed portion that opens in a circular shape on its upper side. However, the shape of the valve element and the shape of the valve seat to support the valve element from below can be varied as appropriate, as long as the valve is closed when the valve element contacts the valve seat by a magnetic force, that is, the fluid discharge path from the inside of the container body to the discharge outlet of the inner plug can be closed. Further, the permanent magnet may be formed in any shape that conforms to the shape of the valve element and the shape of the valve seat to support the valve element from below.

In any case, a configuration may be such that the inner plug includes the hollow portion having its axis in the vertical direction, the valve element is made of a material capable of being attracted by a magnetic force, the permanent magnet is disposed blow the valve seat, the hollow portion of the inner plug opens downward while maintaining a shape of its cross-section orthogonal to the axis, a fluid discharge outlet opens in the top surface on the top side of the hollow portion, and further the discharge outlet has an opening shape included in the shape of the cross-section. Further, a configuration may be such that the planar shape of the valve element when viewed from above is included in the shape of the cross-section of the hollow portion in the inner plug, while including the opening shape of the discharge outlet, the valve seat includes, in its upper surface, the recessed portion having a periphery whose shape is along the planar shape of the valve element, a tubular flow path is formed to open downward extending from an opening provided inside the recessed portion, through a region in which the permanent magnet is provided, and in the closed valve state, a void is formed between the valve element and the upper surface of the recessed portion, while the valve element contacts the periphery of the recessed portion.

What is claimed is:

1. An inner plug structure for a flexible container, the flexible container configured such that a hollow tubular neck portion having a vertical axis is connected to a container body, the neck portion having an opening at a top thereof, the container body made of a flexible material to contain a fluid therein, the inner plug structure comprising:

a tubular inner plug mountable to the neck portion and including a hollow portion therein, the hollow portion having a vertical axis;

a valve element made of a material capable of being attracted by a magnetic force, the valve element being accommodated in the hollow portion of the inner plug so as to be movable in a vertical direction;

a valve seat to support the valve element from below, in a closed valve state; and a permanent magnet disposed below the valve seat, wherein the hollow portion of the inner plug opens downward while maintaining a shape of a cross section of the hollow portion of the inner plug orthogonal to the vertical axis, a discharge outlet for the fluid is disposed in a center of a top surface of the inner plug, the discharge outlet having an opening shape included in the shape of the cross section, a planar shape of the valve element when viewed from above is included in the shape of the cross section of the hollow portion while including the opening shape of the discharge outlet, the valve seat including an upper surface having a recessed portion therein, the recessed portion having a periphery whose shape is along the planar shape of the valve element, a tubular flow path is formed to open downward extending from an opening provided inside the recessed portion, through a region in which the permanent magnet is disposed, in the closed valve state, a void is formed between the valve element and the upper surface of the recessed portion, while the valve element contacts the periphery of the recessed portion, the valve element is always attracted toward the valve seat by the permanent magnet, and when a pressure equal to or greater than a predetermined value is applied, by the fluid in the container, to a bottom surface of the valve element, an open valve state is brought about, and when the pressure is smaller than the predetermined value, the valve is closed, the predetermined value being greater than an attractive force exerted between the valve element and the valve seat, and in the open valve state, the valve element is movable in a range from a position thereof in the closed valve state to a position thereof when contacting the inner periphery of the discharge outlet.

2. An inner plug structure for a flexible container according to claim 1, wherein the inner plug includes a cylindrical hollow portion therein, the hollow portion having a vertical axis in the vertical direction, the valve element has a spherical shape, the permanent magnet has an annular shape and is disposed concentrically with respect to the inner plug, the hollow portion of the inner plug opens downward while maintaining a constant internal diameter of the hollow portion of the inner plug, and the hollow portion has a discharge outlet for the fluid that opens in a top surface on a top side of the hollow portion, the discharge outlet having an opening diameter smaller than an internal diameter of the hollow portion, the valve element has a diameter greater than the opening diameter of the discharge outlet and smaller than the internal diameter of the hollow portion, the valve seat having an upper surface that includes a recessed portion having a circular periphery, the tubular flow path opens downward extending from an opening at a center of the recessed portion, through a hollow portion in which the annular permanent magnet is disposed, in the closed valve state, a void is formed between the valve element and the upper surface of the recessed portion, while the valve element contacts the circular periphery of the recessed portion concentrically.

3. An inner plug structure for a flexible container according to claim 2, wherein the flow path is formed such that a hollow tubular shaft portion is connected to a bottom surface of the valve seat, the shaft portion opening downward while being inserted into the hollow portion in the permanent magnet, and the opening at the center of the recessed portion is connected to a hollow portion of the shaft portion.

4. An inner plug structure for a flexible container according to claim 1, further comprising a seal member to enclose the permanent magnet.

5. A flexible container configured such that a hollow tubular neck portion having a vertical axis is connected to a container body, the container body made of a flexible material to contain a fluid therein, the neck portion having an opening at a top thereof, wherein the inner plug structure is configured to be mounted to the neck portion, the inner plug structure includes a tubular inner plug including a hollow portion therein, the hollow portion having a vertical axis, a valve element made of a material capable of being attracted by a magnetic force, the valve element being accommodated in the hollow portion of the inner plug so as to be movable in a vertical direction, a valve seat to support the valve element from below, in a closed valve state, and a permanent magnet disposed below the valve seat, wherein the hollow portion of the inner plug opens downward while maintaining a shape of a cross section of the hollow portion of the inner plug orthogonal to the vertical axis, as well as the hollow portion has a discharge outlet for the fluid that opens in a top surface on a top side of the hollow portion, the discharge outlet having an opening shape included in the shape of the cross section, a planar shape of the valve element when viewed from above is included in the shape of the cross section of the hollow portion while including the opening shape of the discharge outlet, the valve seat having an upper surface that includes a recessed portion therein, the recessed portion having a periphery whose shape is along the planar shape of the valve element, a tubular flow path is formed to open downward extending from an opening provided inside the recessed portion, through a region in which the permanent magnet is disposed, in the closed valve state, a void is formed between the valve element and the upper surface of the recessed portion, while the valve element contacts the periphery of the recessed portion, the valve element is always attracted toward the valve seat by the permanent magnet, and when a pressure equal to or greater than a predetermined value is applied, by the fluid in the container, to a bottom surface of the valve element, an open valve state is brought about, and when the pressure is smaller than the predetermined value, the valve is closed, the predetermined value being greater than an attractive force exerted between the valve element and the valve seat, and in the open valve state, the valve element is movable in a range from a position thereof in the closed valve state to a position thereof when contacting the inner periphery of the discharge outlet.

6. A flexible container according to claim 5, wherein the inner plug includes a cylindrical hollow portion therein, the hollow portion having a vertical axis, the valve element has a spherical shape, the permanent magnet is disposed around a circle concentrically with respect to the inner plug, the hollow portion of the inner plug opens downward while maintaining a constant internal diameter of the hollow portion of the inner plug, and the hollow portion has a discharge outlet for the fluid that opens in a top surface on a top side of the hollow portion, the discharge outlet having an opening diameter smaller than an internal diameter of the hollow portion, the valve element has a diameter greater than the opening diameter of the discharge outlet, and smaller than the internal diameter of the hollow portion, the valve seat having an upper surface that includes a recessed portion having a circular periphery, the tubular flow path opens downward extending from an opening at a center of the recessed portion, through a hollow portion in which the annular permanent magnet is disposed, in the closed valve state, a void is formed between the valve element and the upper surface of the recessed portion, while the valve element contacts the circular periphery of the recessed portion concentrically.

* * * * *